US009938803B1

(12) United States Patent
Lea, Jr.

(10) Patent No.: US 9,938,803 B1
(45) **Date of Patent: *Apr. 10, 2018**

(54) PLUNGER LIFT SLUG CONTROLLER

(71) Applicant: James F. Lea, Jr., Lubbock, TX (US)

(72) Inventor: James F. Lea, Jr., Lubbock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,424

(22) Filed: Mar. 8, 2016

Related U.S. Application Data

(63) Continuation of application No. 13/528,612, filed on Jun. 20, 2012, now Pat. No. 9,297,247.

(51) Int. Cl.
*E21B 43/12* (2006.01)
*E21B 47/00* (2012.01)
*E21B 34/02* (2006.01)

(52) U.S. Cl.
CPC ..... *E21B 43/121* (2013.01); *E21B 34/02* (2013.01); *E21B 47/00* (2013.01)

(58) Field of Classification Search
CPC combination set(s) only.
See application file for complete search history.

(56) References Cited

U.S. PATENT DOCUMENTS 2,291,902 A 8/1942 Kelley
3,266,574 A * 8/1966 Gandy ..... E21B 43/121 166/53
3,451,477 A 6/1969 Kelley
3,863,714 A * 2/1975 Watson, Jr. ..... E21B 43/121 166/369
4,150,721 A * 4/1979 Norwood ..... E21B 43/00 137/625.64
5,785,123 A 7/1998 Lea, Jr.
6,089,322 A 7/2000 Kelley et al.
7,490,675 B2 2/2009 Hearn
7,806,188 B2 10/2010 Hearn
9,297,247 B2 * 3/2016 Lea, Jr. ..... E21B 43/121
2002/0074118 A1 * 6/2002 Fisher ..... E21B 43/12 166/250.15

* cited by examiner

*Primary Examiner* — D. Andrews
*Assistant Examiner* — Ronald R Runyan
(74) *Attorney, Agent, or Firm* — Gable Gotwals

(57) ABSTRACT

A method for controlling the liquid load size of a plunger lift well during the shut in time of the well to facilitate a controlled plunger rise. Intra-cycle control allows dynamic adjustments within a cycle to keep the plunger running and not stalling out or rising too fast. The method includes the steps of shutting in the well to build up pressure within the well, adjusting a size of a liquid slug within the tubing while the well is shut in, opening a valve to relieve pressure within the well and raise the plunger within the tubing, pushing the liquid slug out of the well with the plunger, and closing the valve wherein the plunger falls within the tubing. The intra-cycle adjustments include reducing the size of the liquid slug for preventing fluid loading and increasing the size of the liquid slug for controlling a rise rate of the plunger.

3 Claims, 6 Drawing Sheets

PLUNGER LIFT SLUG CONTROLLER

CROSS REFERENCE TO RELATED APPLICATIONS

This application is a Continuation of U.S. patent application Ser. No. 13/528,612, filed Jun. 20, 2012, titled, "PLUNGER LIFT SLUG CONTROLLER", which claims the priority of U.S. Provisional Patent Application No. 61/499,001, titled "PLUNGER LIFT SLUG CONTROLLER," filed Jun. 20, 2011, the contents of both of which are hereby incorporated by reference.

BACKGROUND OF THE INVENTION

Liquid loading of the wellbore is often a serious problem in aging production wells. Operators commonly use beam lift pumps or remedial techniques, such as venting or "blowing down" the well to atmospheric pressure to remove liquid buildup and restore well productivity. In the case of blowing down a well, the process must be repeated over time as fluids reaccumulate, resulting in additional methane emissions.

Plunger lift systems are a cost-effective alternative to both beam lifts and well blowdowns and can make use of well energy to lift liquid from the well efficiently, i.e., to lift liquid with little or no slug fallback so that gas can flow without the obstruction of liquid loading for a period of time before the plunger is allowed to fall again. A plunger lift system is a form of intermittent gas lift that uses gas pressure buildup in the casing-tubing annulus and surrounding reservoir to push a plunger, and a column of fluid ahead of the plunger, up the well tubing to the surface. The plunger serves as a piston between the liquid and the gas, which minimizes liquid fallback, and acts as a scale and paraffin scraper.

The operation of a plunger lift system relies on the natural buildup of pressure in a gas well during the time that the well is shut-in, i.e., not producing. The well shut-in pressure must be sufficiently higher than the sales-line pressure to lift the plunger and liquid load to the surface. A surface valve is controlled by a microprocessor for controlling the on and off time of the plunger lift system during periods when gas is vented to the sales line or when the well is shut-in. The controller is normally powered by a solar recharged battery and can be a simple timer-cycle or have solid state memory and programmable functions based on process sensors.

During the off times, casing and tubing pressure build as the plunger falls through gas and liquid and then rests on a bumper spring at the bottom of the well. While the well is open, the plunger and liquid rises and the liquid is produced. The plunger is held in the top of the well during an after-flow period by gas flow. As the gas flow diminishes below a critical value, liquid begins to accumulate in the bottom of the tubing. Liquid accumulated in the bottom of the tubing is evidenced by surface measurements that show casing pressure being higher than tubing pressure during the shut in period.

Operation of a typical plunger lift system involves the following steps: The plunger rests on a bottom hole bumper spring located at the base of the well. As gas is produced to a sales line, liquids accumulate in the well-bore, creating a gradual increase in backpressure that slows gas production. To reverse the decline in gas production, the well is shut-in at the surface by an automatic controller. This causes well pressure to increase as a large volume of high pressure gas accumulates in the annulus between the casing and tubing. Once a sufficient volume of gas and a sufficient pressure is obtained, the plunger and liquid load are pushed to the surface. As the plunger is lifted to the surface, gas and accumulated liquids above the plunger flow through the upper and lower outlets. The plunger arrives and is captured in the lubricator, situated across from the upper lubricator outlet. The gas that has lifted the plunger flows through the lower outlet to the sales line. Once gas flow is stabilized, the automatic controller releases the plunger, dropping it back down the tubing. The cycle repeats. The above is known as a plunger cycle.

Overall control of a plunger cycle can be implemented in different ways. One simple way involves opening a control valve when high casing pressure is experienced and flowing gas and liquid until a low casing pressure is achieved. Alternatively, the control valve may be opened when a high tubing pressure is experienced or the control valve may be closed when a low tubing pressure is experienced. These simple methods may require trial and error to get to continuous repeating cycles, i.e., to prevent the well from becoming liquid loaded.

Another example of an overall control algorithm involves monitoring rise velocity of the plunger and liquid. Experience has shown that arrival between 500-1000 fpm is a good operating range. Using this method, if the plunger and liquid come up faster than 1000 fpm, then the controller may be instructed to shut in for a shorter time during a following cycle, which would result in less casing pressure to lift the plunger and liquid. However, the controller must still facilitate a shut in that is long enough for plunger to fall to bottom of the well. Additionally, the well could flow longer during a following cycle, accumulating more liquid to make the plunger and liquid rise more slowly, i.e., within the range of 500-1000 fpm, as longer flow time below critical accumulates more liquid in the tubing. In this example, the controller looks at the current cycle and makes recommendations for timing of control valve opening and closing for the next cycle.

Using the same method, if the plunger were to rise too slowly, then the shut in time may be increased on the next cycle to give more casing pressure to lift the plunger more quickly. Alternatively, the flow time may be decreased to lift a smaller liquid slug. However, the flow time for the next cycle must be long enough to accumulate some liquid because if no liquid is accumulated, then the plunger will rise too fast and may cause damage.

The above are examples of overall cycle control. However, the control depends on the current cycle performance for making operational recommendations for the next cycle. A potential drawback is that too much liquid is accumulated in a current cycle, resulting in the plunger not rising in the next cycle, i.e., loading the well. Alternatively, the liquid slug may be too small and the plunger will rise too fast in the current cycle and do damage before adjustments are made.

New information technology systems have streamlined plunger lift monitoring and control. For example, technologies such as online data management and satellite communications allow operators to control plunger lift systems remotely, without regular field visits. Operators typically visit only the wells that need attention, which increases efficiency and reduces cost.

SUMMARY OF THE INVENTION

Therefore, one object of the invention is to control the size of the liquid load during the shut in time so that plunger will rise and not stall out. The intra-cycle, i.e., "within the cycle", method of the invention does not require assessing performance on a completed current cycle to make recommendations for a subsequent cycle. The current practice of making adjustments for subsequent cycles based on information from completed current cycles results in an inability to adjust for the case where the current liquid load is too large, i.e., where the liquid and plunger will not rise. In contrast, with the method of the invention, over all control is still to be used but intra-cycle control will allow dynamic adjustments within a cycle to keep the plunger running and not stalling out or rising too fast.

A typical plunger lift cycle consists of the following steps:

First, a plunger is located at the bottom of a well on a bumper spring. Some liquid is present above the plunger. As time passes, some tubing pressure and some casing pressure builds.

Second, a main valve or tubing valve at the surface opens to lower line pressure and the plunger rises with produced gas. As pressure is reduced, expanding casing gas pushes the plunger from below. The plunger holds the slug together with minimum fall back as the plunger rises.

Third, as the plunger hits the surface, liquid is pushed out, i.e., into the production line. Flow and pressure hold the plunger at the surface as gas produces out one or two lines from the lubricator to the flow line. The gas flow is initially high and the gas carries liquid out as mist. As the flow drops with time the gas flow drops below critical and liquids begin to be left behind in the tubing below. A check valve may or may not be provided with the bumper spring. The check valve may or may not be spring loaded.

Fourth, once liquids accumulate in the tubing as measured by casing pressure increase or from a measured difference between casing pressure and tubing pressure on subsequent cycles, then the main valve closes. The plunger will then fall, first through gas and then through the accumulated liquid to rest on the bumper spring. Some additional time may then be needed to build enough pressure in the casing to lift the liquids with the plunger at an appropriate velocity, i.e. between 500 and 1000 fpm. The well must be shut in for at least the time required for the plunger to fall through the gas and liquid. The well may need to be shut in for an additional time to build sufficient pressure lift the liquid. Different styles of plungers fall at different rates through gas/liquid. The cycle then returns back to the first step, discussed above, and the cycle repeats. The phase of the plunger cycle from closure of the main valve in step four through step one, described above, may be referred to as the shut-in period.

The method of the invention provides intra-cycle, i.e. within the cycle, control by adjusting the size of the liquid slug during the shut in portion of the overall plunger cycle so that the plunger and liquids will rise, but not rise too fast.

The liquid slug is reduced by opening a control valve for short periods and then re-examining the liquid slug size by determining the difference between casing pressure and tubing pressure at the surface. Opening of the control valve is repeated as necessary during the shut in phase of the plunger cycle to adjust the liquid slug size to a manageable size. The liquid slug size should be below an input large threshold value. If the liquid slug size is maintained at a manageable size, then the plunger and liquids will rise to the surface, i.e., the plunger cycle will not stall out due to a large amount of liquid that inadvertently comes into the tubing.

Another problem relates to a condition wherein no liquid or too little liquid is present in the tubing. If this condition is encountered, then the amount of liquid in the tubing can be increased by opening the tubing main valve for short periods to lower the line pressure, which will allow more liquid to enter the tubing from the casing. However, if the end of tubing is above the casing perforations where gas and liquids enter the well, there may be no liquids present at the end of the tubing to flow into the tubing.

The purpose of some existing controllers is to either reduce flow time or increase the shut in time for a following plunger cycle, i.e., to make "next cycle adjustments", if the liquid in tubing accumulated during the flow period of a current flow cycle is deemed to have been too high, resulting in a low arrival velocity of the plunger.

Alternatively, the purpose of some existing controllers is to increase the flow time and decrease the shut in time for a following plunger cycle, i.e., to make "next cycle adjustments", if the liquid in the tubing accumulated during the flow period of a current plunger cycle is too small and the arrival velocity of the plunger is too fast.

The method of the invention controls the size of the liquid slug within the shut in time of the current plunger cycle and allows adjustments prior to the next cycle adjustments. "Next cycle adjustments" are still deemed desirable. However, reliance on "next cycle adjustments" alone, could allow the well to liquid load or could allow the plunger to arrive too fast if adjustments are made at the completion of the current cycle and prior to the next cycle rather than being made immediately, i.e., within the cycle, as suggested by the method of the invention.

The method of the invention allows for intra-cycle adjustment, i.e., allows for adjustment during the shut in portion of the total plunger cycle. Intra-cycle adjustments keep the plunger continuously cycling. As stated above, the method of the invention does not exclude controller adjustments of the next total plunger cycle based on performance of the current cycle. For example, if a slug of liquid is too large and the lower vent line valve is opened one or more times to allow the plunger to rise with a reduced load of liquid, the next cycle could still be handled with a cycle to cycle adjustment that is typically made for the case of too much liquid being present. The next cycle may still be adjusted according to current practices.

Additionally, if the tubing valve was opened during the shut in portion of the total plunger cycle, cycle to cycle adjustments could still take place as if the liquid level was too low regardless of whether the intra-cycle adjustments of the invention were made.

DETAILED DESCRIPTION OF THE PREFERRED EMBODIMENTS

Figure 1:
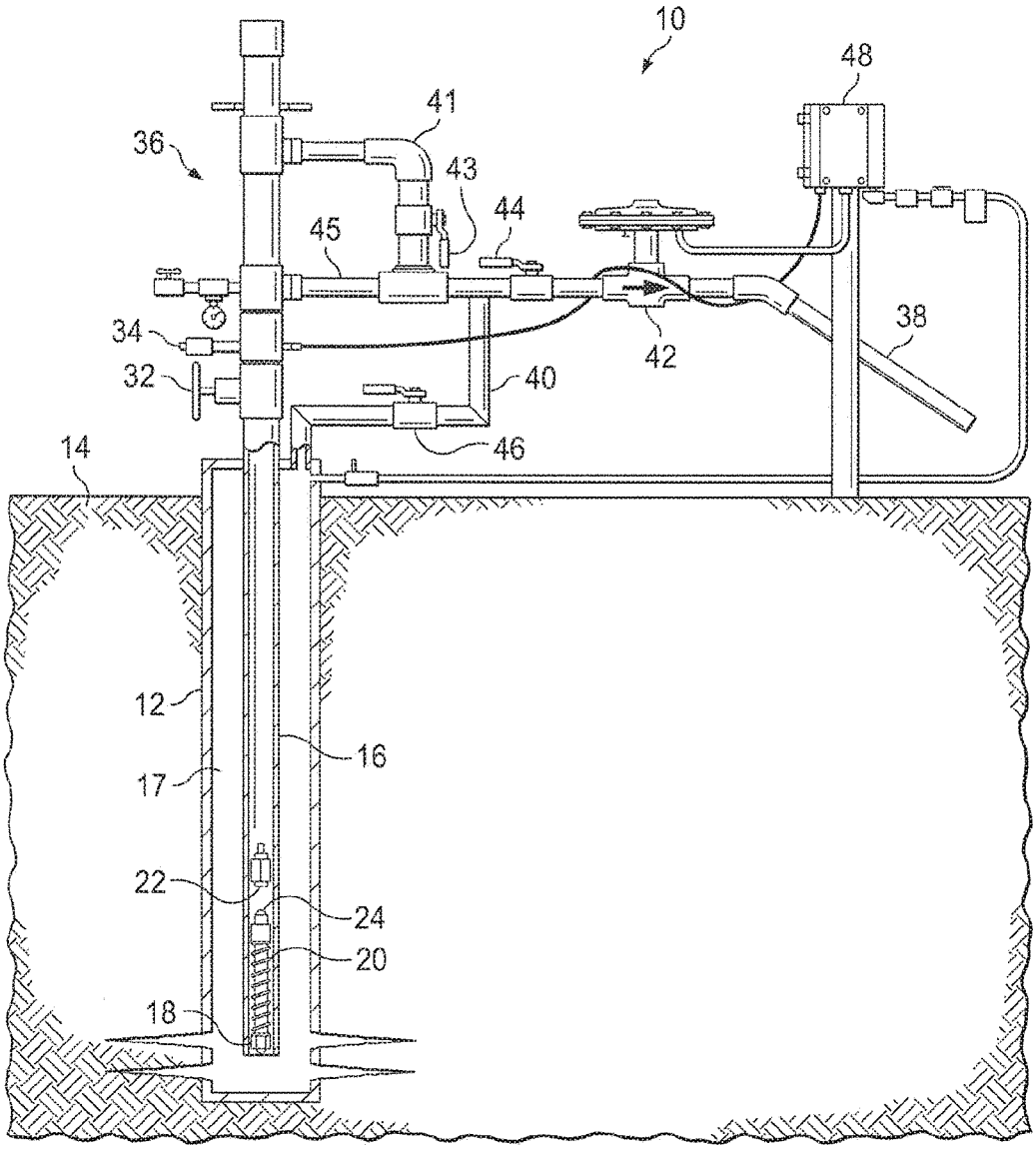
FIG. 1 shows a plunger lift well of the invention.

Referring to FIG. 1, shown is a plunger lift well 10 having casing 12 that extends below a ground surface 14. Tubing 16 extends into casing 12, defining annulus 17 therebetween. A tubing stop 18 is affixed at a lower end of tubing 16. A bumper spring 20 is supported by tubing stop 18 for engaging plunger 22 when plunger 22 falls during shut in of well 10.

Figure 2A:
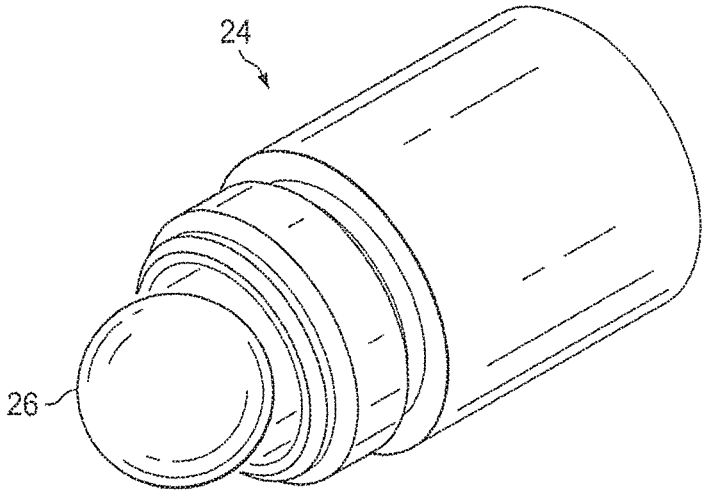
FIG. 2 shows a spring loaded check valve for locating at the bottom of the well of FIG. 1.
Figure 2B:
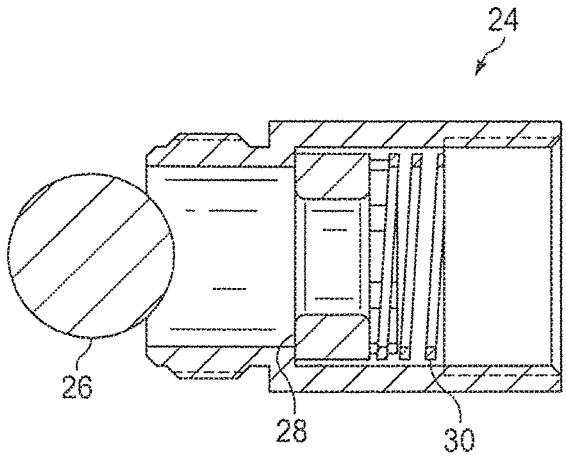

The bumper spring assembly 20 may include a spring loaded ball and seat assembly 24 (FIGS. 1, 2) made up of ball 26 received within seat 28. Relief spring 30 communicates with seat 28. Spring 30, having a correctly set spring compression, will prevent liquid in tubing 16 from falling out of tubing 16 during a shut in period of the plunger lift cycle. However, if the compression force of relief spring 30 is low enough, then equalizing pressure between casing 12 and tubing 16 for short intermittent times should still allow for compression of spring 30 and for some liquid to be pushed through seat 28. If the compression of spring 30 is set too high, then liquids will not be forced through seat 28 when tubing and casing are equalized. The spring loaded ball and seat assembly 24 should not substantially affect inflow of liquids if tubing valve 32 is opened as ball 26 can open over the seat 28 as with any standing valve. In a well where liquids are not been falling out of tubing 16 during well shut in, then a spring loaded ball and seat assembly 24 or other type of check valve is not required.

An upper portion of tubing 16 may be closed off with tubing valve or master valve 32. A catcher 34 with arrival sensor is located above tubing valve 32 and a lubricator 36 is affixed to an upper end of tubing 16. Production line 38 communicates with lubricator 36 above tubing valve 32. Bypass line 40 communicates annulus 17 between casing 12 and tubing 16 with production line 38. Upper vent line 41 communicates production line 38 with lubricator 36. Lower vent line 45 also communicates production line 38 with lubricator 36. Upper vent line valve 43 is provided to adjust the pressure drop across plunger 22 when plunger 22 has risen to a location within lubricator 36 by controlling an amount of gas flowing through the upper and lower vent lines 41 and 45.

Motor valve 42 is provided on production line 38. Motor valve 42 is preferably a diaphragm-operated device controlled by controller 48 to selectively open and close production line 38. Shutoff valve 44 is provided on production line 38 upstream of motor valve 42. Bypass line valve 46 is located on bypass line 40.

The apparatus of well 10, described above, is used to control a size of liquid slug 23 at a bottom of tubing 16 during the shut in phase of a plunger cycle. The method for controlling the size of liquid slug 23 includes the steps of closing one or both of shutoff valve 44 and motor valve 42 to achieve shut in of well 10. Bypass line valve 46 on bypass line 40 is opened for a short period of time while shutoff valve 44 and motor valve 42 are closed. Opening bypass line valve 46 communicates annulus 17, which contains "casing pressure", with tubing 16, which contains "tubing pressure". This will begin to equalize pressure in the casing 12 and pressure in tubing 16 as measured at the surface. The pressure equalization will allow liquids in the bottom of tubing 16 to begin to flow back into the casing 12.

Measurements are taken to determine whether a pressure differential between pressure in tubing 16 and pressure in annulus 17 of casing 12, measured at the surface, is below a predetermined threshold value. An example of a desirable pressure differential may be determined by the Foss and Gaul method, described in SPE 120636, "Modified Foss and Gaul Model Accurately Predicts Plunger Rise Velocity" by O. Lynn Rowlan, Echometer Company, SPE Member 0917344 and James F. Lea, PLTech LLC, SPE Member 009772-5 and J. N. McCoy, Echometer Company, SPE Member 0017843, said article incorporated herein by reference. Alternatively, the upper limit for the pressure differential could be determined from a previous plunger cycle wherein liquid slug 23 was found to be large enough to prevent cycling of plunger 22. A lower limit could be set to ensure that a specific quantity of liquid 23 remained in tubing 16, e.g., 10% of a barrel of liquid.

The step of opening bypass line valve 46 for a short period of time is repeated if the pressure differential between pressure in casing annulus 17, i.e., the casing pressure, and pressure in tubing 16, i.e., the tubing pressure, is above the predetermined threshold value. Maintaining the pressure differential below the threshold value prevents an accumulation of a large slug of fluid 23 in tubing 16. Bypass line valve 46 may be opened repeatedly for brief periods to allow liquid to flow from tubing 16 to the casing 12. Bypass line valve 46 is then shut and measurements are taken to determine if the difference between the pressure in casing 12 and the pressure in tubing 16 has dropped below the threshold value.

Figure 3:
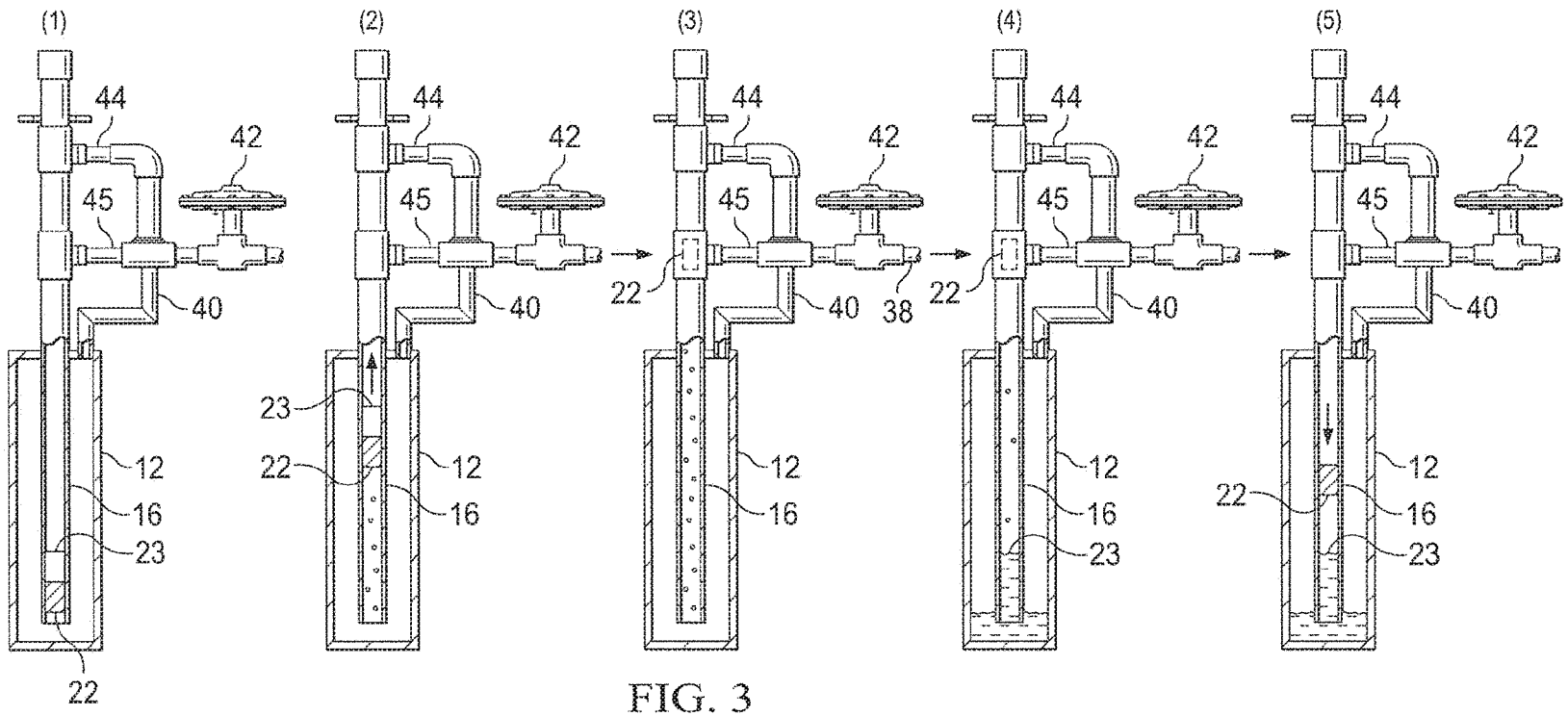
FIG. 3 lists the events of a plunger cycle of the plunger lift well of FIG. 1.

The phases of a plunger cycle are shown graphically in FIG. 3. As explained above, motor valve 42 is shut after a flow period and liquid 23 accumulates downhole, allowing plunger 22 to fall back downhole. FIG. 3(1) shows plunger 22 downhole. FIG. 3(1) shows well 10 closed, or shut-in, wherein pressure in casing 12 is building. Plunger 22 rests on bottom hole bumper 20 (not shown in FIG. 3(1)) at the base of well 10. FIG. 3(2) shows motor valve 42 in an open condition to allow gas to flow from tubing 16 into flow line 38. Plunger 22 and liquid 23 rise within tubing 16. FIG. 3(3) shows plunger 22 held at ground surface 14 as gas flows through lubricator 36 into production line 38 and through motor valve 42. FIG. 3(4) illustrates that most liquids 23 accumulate when gas velocity drops before motor valve 42 shut. FIG. 3(5) shows that when motor valve 42 shuts, plunger 22 falls toward liquid 23.

During the time the motor valve 42 is shut, i.e., during the shut-in phase, as shown in FIGS. 3(5) and 3(1), plunger 22 falls through gas, then falls through liquid 23 and then rests on bottom hole bumper spring 20.

Figure 4:
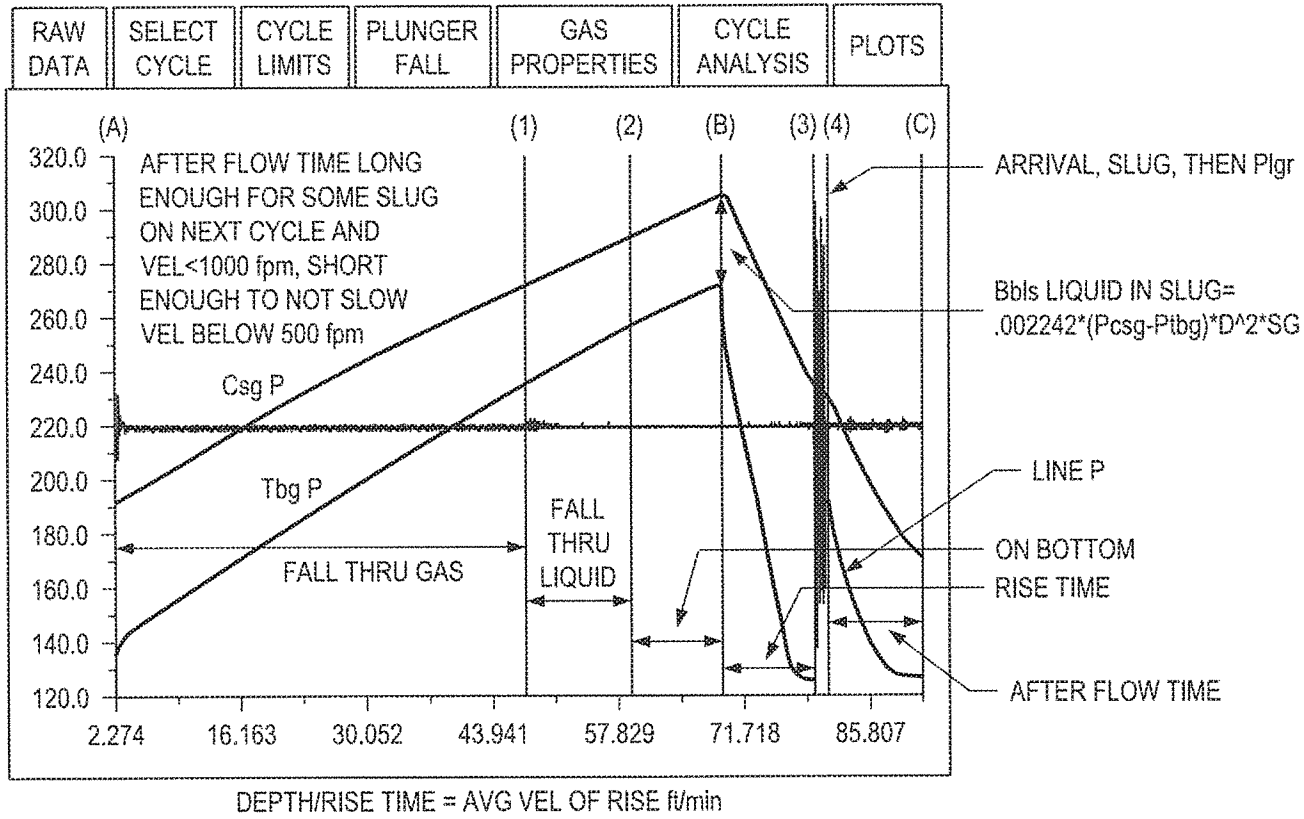
FIG. 4 is a graphical representation of surface recorded casing and tubing pressures during the plunger cycle shown in FIG. 2.

FIG. 4 shows surface recorded pressures for casing 12 and for tubing 16 during a typical plunger cycle described above. Pressure in casing 12, i.e., the casing pressure (Csg P) is higher than the pressure in tubing 16, i.e., the tubing pressure (Tbg P), due to liquid load downhole. As shown in FIG. 4, casing pressure (Csg P) and tubing pressure (Tbg P) rise from event (A), when motor valve 42 (FIG. 1) shuts. From event (A) through event (1), plunger 22 falls through gas. From event (1) to event (2), plunger 22 falls through liquid 23. From event (2) to event (B), plunger 22 rests on bumper spring 20. At event (B), motor valve 42 is opened. At event (B), the pressure differential between the casing pressure (Csg P) and the tubing pressure (Tbg P) is indicated by the vertical arrow. From event (B) to event (3), plunger 22 rises within tubing 16. From event (3) to event (4), liquid slug 23 and plunger 22 arrive at lubricator 36. From event (4) to event (C) casing pressure (Csg P) and tubing pressure (Tbg P) continue to drop during an after flow period with plunger 22 in lubricator 36. At event (C), motor valve 42 closes again and the plunger cycle repeats.

If, during the shut in portion of the plunger cycle, i.e, from event (A) to (B) in FIG. 4, liquid leaves the bottom of tubing 16 and flows back to casing 12, which it sometimes does, pressure in casing 12 and in tubing 16 will begin to equalize. During the shut in portion of the cycle, pressure in casing 12 (Csg P in FIG. 4) and pressure in tubing 16 (Tbg P in FIG.

4) rise as gas from well 10 pressurizes casing 12 and tubing 16. Liquid 23 may or may not exit from the bottom of the tubing 16 if no check valve, e.g., ball and seat assembly 24, is present. To control the conditions under which liquid 23 can escape from the bottom of tubing 16, a check valve may be added at the bottom of well 10 so that pressure exerted from the surface in tubing 16 will open the check valve, e.g., check valve assembly 24, and force out liquid 23 from tubing 16 only if pressure in tubing 16 is greater than a desired threshold. This may allow tubing 16 to be unloaded without swabbing or pulling tubing 16 if too much liquid is present in tubing 16. In the case of moderate liquid loading, liquid 23 may remain in tubing 16 for lifting by plunger 22 as described above.

In summary, so long as liquid level is not too high, liquid 23 may be allowed to build up and be subsequently lifted by plunger 22. However, if the liquid level is too high, then the casing pressure and the tubing pressure may be equalized during the plunger cycle, e.g., from event (A) to event (B) in FIG. 4. Upon pressure equalization, which may be partial or full, liquid 23 flows out of tubing 16 either through a lightly compressed spring check valve, i.e., through check valve 24, or out of a bottom of tubing 16 having no check valve. Pressure is preferably partially equalized in short spurts during the shut in phase of the plunger cycle to control the amount of liquid 23 present in the well for avoiding a potential liquid loading of well 10.

Figure 5:
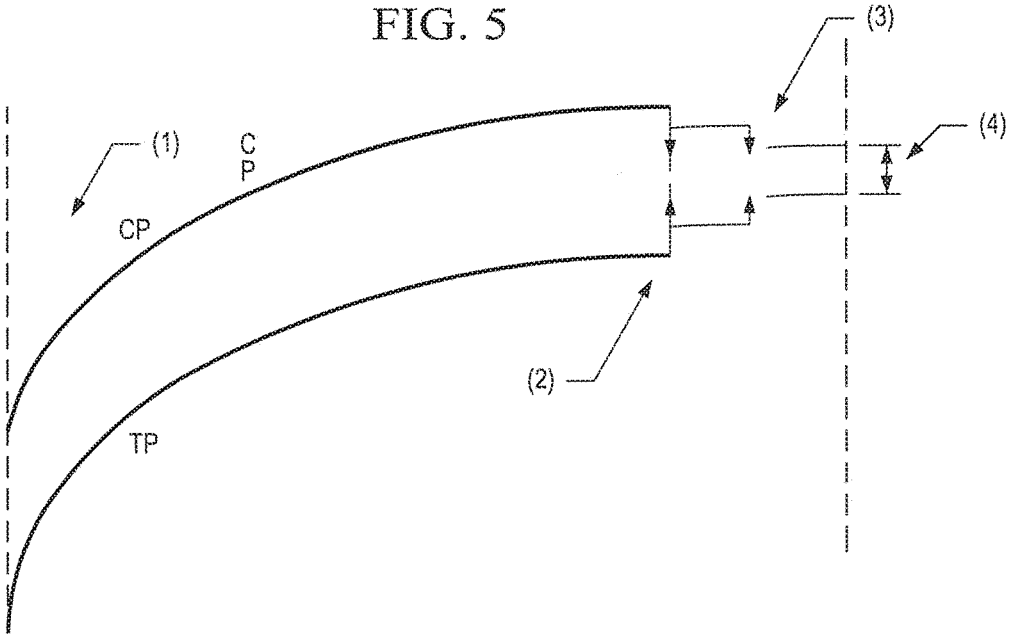
FIG. 5 is a pressure versus time plot showing the effects of controlling, i.e., reducing to a smaller size, a large liquid slug during the shut-in period of the plunger cycle.

Referring now to FIG. 5, shown is a graphical representation of the steps for controlling a liquid slug 23 that is too large during the shut in period of a plunger cycle. Event (1) indicates well shut in. After event (1), casing pressure (CP) and tubing pressure (TP) begin to rise. Plunger 22 falls through gas, then through liquid 23. Plunger 22 will then remain for a short time on bottom of tubing 16, e.g., on bumper spring 20. At event (2), controller 48 equalizes casing pressure (CP) and tubing pressure (TP) for short time by opening bypass line valve 46. As shown in FIG. 5, a drop in casing pressure-tubing pressure differential occurs after event (2), which is indicative of a decrease in the size of liquid slug 23. Pressure equalization action is taken if a difference between casing pressure minus tubing pressure is larger than a predetermined threshold. A large pressure differential indicates a liquid slug 23 at the bottom of tubing 16 that is too large during the shut in period of the plunger cycle. If necessary, at event (3), controller 48 partially equalizes casing pressure and tubing pressure by briefly opening bypass line valve 46 during shut in. The size of liquid slug 23 then decreases, as is indicated by a drop in the casing pressure-tubing pressure differential. By repeatedly opening bypass line valve 46, the casing pressure-tubing pressure differential is reduced below an input acceptable value. At event (4), the size of liquid slug 23 is now below a maximum set point as determined by the set difference between casing pressure and tubing pressure. This keeps a large slug of liquid from stopping the plunger cycles. Plunger 22 is given time to fall through gas, liquid 23 and then arrive at the bottom of tubing 16. Motor valve 42 is then opened to communicate tubing 16 with production line 38 and plunger 22 rises. A height of liquid slug 23 in the bottom of tubing 16 may be determined from the following equation:

$$\text{Height of liquid, ft} = (\text{CP} - \text{TP, psi})/(0.433\ \text{psi/ft} \times \text{SpGr of liquid})$$

Control of the size of liquid slug 23 can occur earlier in the plunger cycle and can occur more than the 2 times illustrated in FIG. 5.

Figure 6:
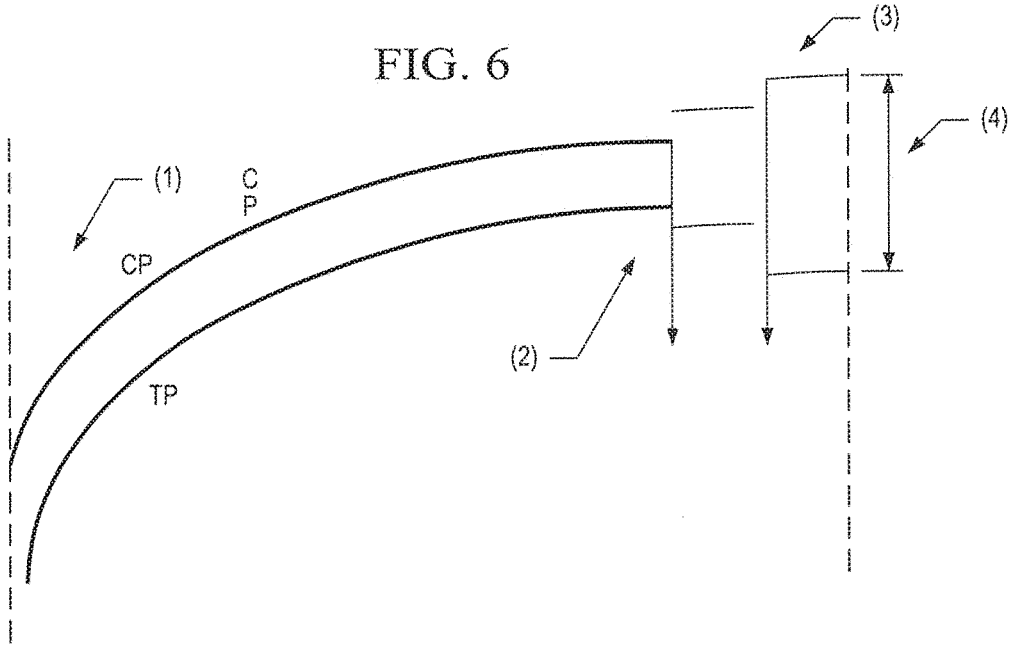
FIG. 6 is a pressure versus time plot showing the effects of controlling, i.e., increasing to a larger size, a liquid slug of small size during the shut-in period of the plunger cycle.

Referring now to FIG. 6, shown are the steps for controlling a liquid slug 23 that is too small during a shut-in period of a plunger cycle. Event (1) indicates well shut in, e.g., by closure of motor valve 42. After event (1), casing pressure (CP) and tubing pressure (TP) rise. Plunger 22 falls through gas, then through liquid 23 and then remains on the bottom of tubing 16 for a short period. Event (2) indicates that tubing pressure is briefly vented to production line 38 (FIG. 1), e.g., by opening tubing valve 32. This action may be taken when the difference between the casing pressure and the line pressure is determined to be too small. Venting tubing pressure to production line 38 ensures that tubing 16 is at lower pressure than the pressure in annulus 17 of casing 12, i.e., than the casing pressure. If liquids are proximate to the bottom of tubing 16 in casing 12, then the liquids will flow into the bottom of tubing 16. At event (3) of the shut in period, tubing pressure is briefly vented to production line 38 for a second time. Venting to production line 38 is undertaken when a difference between casing pressure and line pressure is determined to be too small. Venting tubing pressure to production line 38 allows more fluid in casing 12 to enter bottom of tubing 16. By venting tubing pressure to production line 38, a larger casing pressure-tubing pressure differential is achieved. Event (4) indicates that a size of liquid slug 23 is above a minimum set point as determined by a predetermined set difference between casing pressure and tubing pressure. Plunger 22 is then given time to fall through gas, liquid 23 and then locate on bottom of tubing 16. Well 10 is then opened, e.g., motor valve 42 is opened, to communicate tubing 16 to production line 38. Plunger 22 then rises. Control the size of liquid slug 23 can occur earlier in the plunger cycle and can occur more or less than the two times illustrated in FIG. 6.

Figure 7:
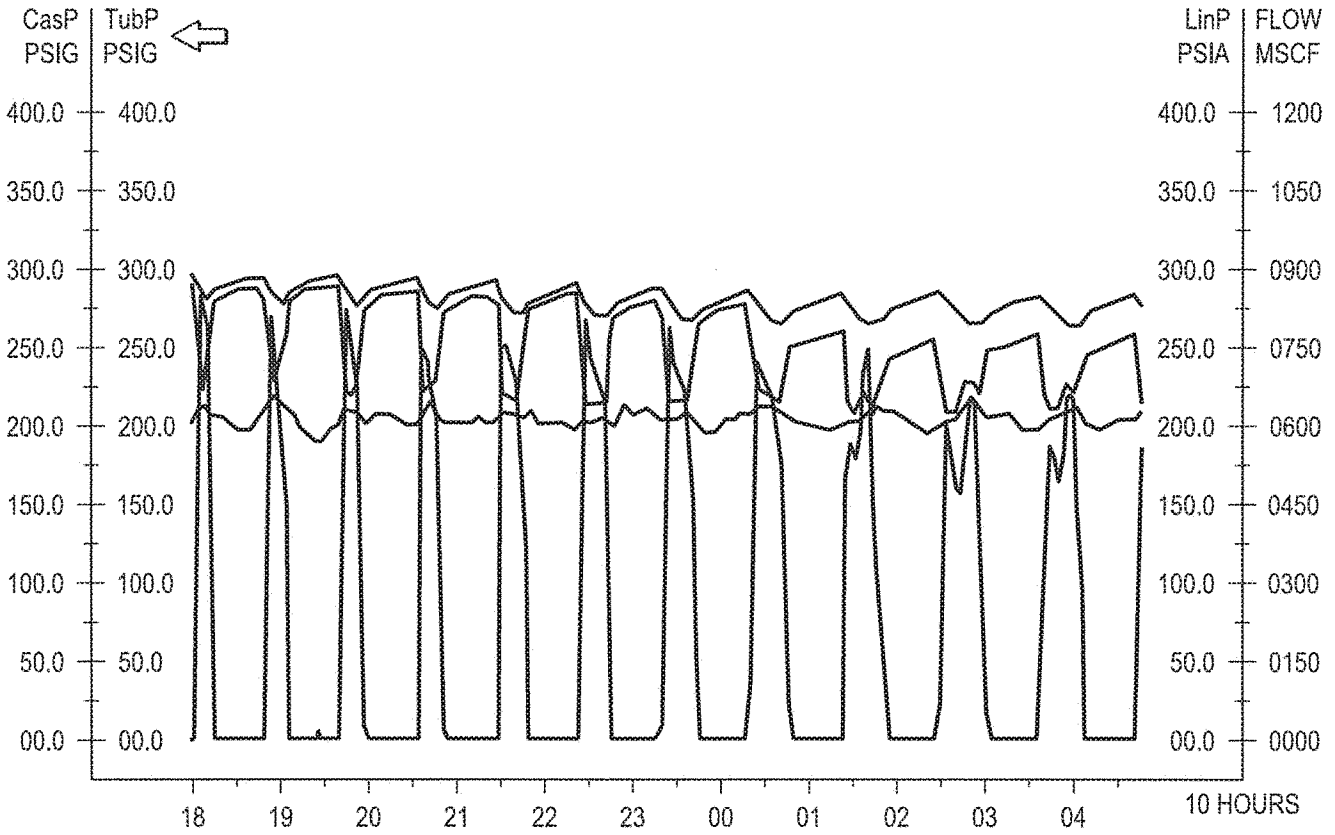
FIG. 7 is a graphical representation of changing liquid load due to multiple plunger cycles.

FIG. 7 is a graphical representation of changing liquid load and how the difference between the pressures in casing 12 and tubing 16 can change during controlled plunger cycles to avoid liquid slug 23 becoming too large, which could result in a stoppage of the plunger cycle and liquid loading of well 10. Lower vent line valve 46 is opened while motor valve 42 and shut off valve 44 are closed during the shut in portion of the plunger cycle. Casing pressure and tubing pressure rise, indicating shut in. Rising pressures allow higher pressure in casing 12 to act on the top of tubing 16 during short trial openings of bypass line valve 46, which equalizes the casing pressure and the tubing pressure, at least to some extent. If casing pressure and tubing pressure are allowed to completely equalize then liquid slug 23 in tubing 16 falls completely back into casing 12 or drops to a very low level in the bottom of tubing 16 as liquids flow from tubing 16 back into annulus 17 of casing 12, i.e., into casing 12, which is at a lower pressure.

In one aspect of the invention, the pressure difference between the pressure in casing 12 and the pressure in tubing 16 is lowered during the shut in portion of the plunger cycle. Preferably, the two pressures are not equalized, but rather the differential between the pressures are lowered below a threshold input value. By avoiding a large pressure differential, plunger 22 does not have to lift a large slug of liquid 23 and possibly fail to arrive at the surface. Therefore, controller 48 should open bypass line valve 46 for a short time during the shut in period of the plunger cycle to reduce the difference in the tubing pressure above liquid 23 in tubing 16 and the casing pressure to below a threshold input value as measured at the surface. If the pressure differential is above the threshold input value, then the process is repeated. Even if the pressure difference is not reduced by repeating the procedure and checking the pressures, the size of liquid slug 23 may be reduced and the total plunger cycle will have a much better chance to continue to repeat the open and close portions of the normal plunger cycle. The method of the invention prevents plunger 22 from operating with a randomly sized, possibly larger than normal liquid slug 23 in tubing 16. A large liquid slug 23 is undesirable because it could stop operation of the plunger cycles and result in a need for a restarting procedure. A restarting procedure takes time, manpower, and may stop well production for a period of time.

If the difference between the surface measured pressures in casing 12 and tubing 16 during the shut in period of the plunger cycle is too small, then this condition indicates that liquid slug 23 in tubing 16 is too small or may be non-existent. To increase the size of liquid slug 23, motor valve 42 is briefly opened while casing bypass valve 46 is closed and shut off valve 44 is open, to allow some gas to leave tubing 16 and allow more liquid to enter tubing 16. Controller 48 will repeat this process and measurements will be taken to determine if the tubing pressure and casing pressure differential has risen above the input minimum value. By ensuring that the pressure differential has risen above a minimum value, plunger 22 is prevented from rising with no liquid slug 23. The presence of only a small amount of liquid 23 or the absence of any liquid 23 can cause rapid arrivals at ground surface 14 of plunger 22, which can damage well equipment.

In general, described above is a method to control the size of liquid slug 23 at the bottom of tubing 16 during the off portion, or shut in portion, of a plunger cycle. By controlling the size of liquid slug 23, controller 48 is allowed to continue cycling and not stop due to a large liquid slug 23. Additionally, damage to well equipment due to operating with too small of liquid slug 23 may be avoided. Various types of plumbing and valves might be present at the well head but would still allow operation of the invention as described herein.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method of intra-cycle adjustment in a plunger well having a plunger within tubing comprising the steps of:

shutting in the well to build up pressure within said well;

determining a size of a slug of liquid in the tubing:

comparing the size of the slug of said liquid with a large threshold value and a lower limit;

controlling the size of said slug of said liquid within the tubing while said well is shut in to ensure that said size of said slug of said liquid is between said large threshold value and said lower limit;

opening a valve to relieve pressure within said well and raise the plunger within said tubing;

pushing said slug of said liquid out of said well with said plunger;

closing said valve wherein said plunger falls within said tubing;

reducing said size of said liquid slug for preventing fluid loading; and lowering pressure in an annulus defined by said tubing and casing for equalizing tubing pressure and casing pressure.

2. The method according to claim 1 wherein said step of controlling comprises:

increasing said size of said liquid slug for controlling a rise rate of the plunger.

3. The method according to claim 2 wherein said step of increasing comprises:

lowering pressure within said tubing for allowing more liquid to enter said tubing.

* * * * *